US005167219A

United States Patent [19]

Ehmke

[11] Patent Number: 5,167,219

[45] Date of Patent: Dec. 1, 1992

[54] FRAME ASSEMBLY FOR A FIREPLACE OPENING

[75] Inventor: Robert J. Ehmke, Germantown, Wis.

[73] Assignee: Design Specialties, Inc., Milwaukee, Wis.

[21] Appl. No.: 670,292

[22] Filed: Mar. 14, 1991

[51] Int. Cl.[5] ..... F24B 1/192

[52] U.S. Cl. ..... 126/547; 126/500; 126/545; 126/546; 126/544; 49/410

[58] Field of Search ..... 126/547, 544, 546, 545, 126/548, 500; 49/410, 411, 425, 38; 160/DIG. 9

[56] References Cited

U.S. PATENT DOCUMENTS

| | | | |
|---|---|---|---|
| 2,518,005 | 8/1950 | Gustafson et al. | 126/544 |
| 2,846,998 | 8/1958 | Robinson | 126/544 |
| 3,457,907 | 7/1969 | Brunig | 126/545 |
| 4,086,906 | 5/1978 | Reichgut | 126/546 |
| 4,245,614 | 1/1981 | Hurwitz et al. | 126/545 X |
| 4,913,131 | 4/1990 | Petersen | 126/500 |

*Primary Examiner*—Larry Jones
*Attorney, Agent, or Firm*—Godfrey & Kahn

[57] ABSTRACT

A frame assembly (10) for a fireplace opening (12) comprises a frame member (24) and a clip (26). The frame member (24) includes segments (28, 30, 32, and 34) of discrete length that are fitted to sidewall portions (14, 16, 18, and 20) of the fireplace opening (12). The frame member (24) has semicircular channel (46) and an access opening (48) to the channel that are directed longitudinally along the length of the frame member (24). The clip (26) includes a lip (72) that is sized to be received within the semicircular channel (46) of the frame member (24), the clip (26) being slidable or otherwise positionable at desired locations along the length of any of the segments (28, 30, 32, and 34). The clip (26) extends outwardly from the frame member (24) for attachment to the sidewall portions (14, 16, 18, and 20) of the fireplace opening (12) by a fastener (90) that extends through an aperture (76) in the clip (26).

10 Claims, 7 Drawing Sheets

FRAME ASSEMBLY FOR A FIREPLACE OPENING

FIELD OF THE INVENTION

The present invention relates generally to frame assemblies for fireplace openings, and more particularly to means for attaching such frame assemblies to the fireplace openings.

BACKGROUND OF THE INVENTION

Fireplace openings are often made aesthetically appealing by the addition of a frame assembly and which includes doors which are commonly made of glass and which are mounted therein. The frame assembly provides an attractive facing or border to the fireplace opening, and the incorporation of doors within a fireplace opening may serve a functional as well as aesthetic purpose to close off the opening when the fireplace is not in use, and further to substantially occlude the fireplace opening when the fireplace is in use to prevent hot embers from being ejected into the immediate living space thereby creating a fire hazard.

A frame assembly may be mounted within an opening as part of the original equipment, or may be added later as an improvement to the fireplace. In either case, the assembly process is often labor-intensive, commonly requiring drilling of the frame members or pieces and other pre-preparation of the parts. Such advanced preparation of the parts, as should be understood, may damage the integrity of the parts and/or be aesthetically unappealing, and in plain view to observers when the fireplace door is open.

Accordingly, the need has existed for a frame assembly that is easily attached to the fireplace opening without an excessive amount of labor and that is attachable without compromising the aesthetic appearance or integrity of the frame members or other component elements which comprise same.

SUMMARY OF THE INVENTION

In accordance with the present invention, a frame assembly includes discrete elements or segments that fit against the side wall portions of the fireplace opening, and independent clips serve as a means of attaching the frame member to the opening. The frame member has a forwardly facing surface, a rearwardly facing surface, an exterior facing surface, and an interior facing surface. The exterior facing surface is shaped to conform to the particular type of fireplace opening that is involved. Further, the interior facing surface interfaces with the fireplace door, and the forwardly facing surface provides an attractive front to the frame assembly. The rearwardly facing surface includes as a major feature a semicircular channel which is formed therein and which provides an access opening that runs the length of the frame member.

The above-identified clip is formed of a plate that has a planar portion and a lip. A portion of the plate proximal one of the edges is rolled into a semicircular configuration thereby forming the lip. The lip of the clip is sized to be received within the semicircular channel of the frame member and may be inserted into the channel at any point along the length of the frame member. A screw or other type of fastener may then be extended through an aperture formed in the planar portion of the clip thereby penetrating the side wall of the fireplace opening, and thus attaching the frame member to the opening.

The frame assembly of the present invention allows for the attachment to a fireplace opening without disparagement of the frame members which may be occasioned by drilling or the like. The result is that there are no screws or attachment means that extend through the frame member which may otherwise contribute to an aesthetically unappealing installation. The clips may be positioned at any position along the length of the individual segments of the frame member for a greatly facilitated and customized attachment procedure. Further, because of the unique structure of the frame assembly of the present invention, the attachment procedure is not labor-intensive, resulting in savings with respect to the installation costs.

Further objects, features, and advantages of the present invention will become apparent from the following detailed description, taken in conjunction with the accompanying drawings.

DESCRIPTION OF THE PREFERRED EMBODIMENT

Figure 1:
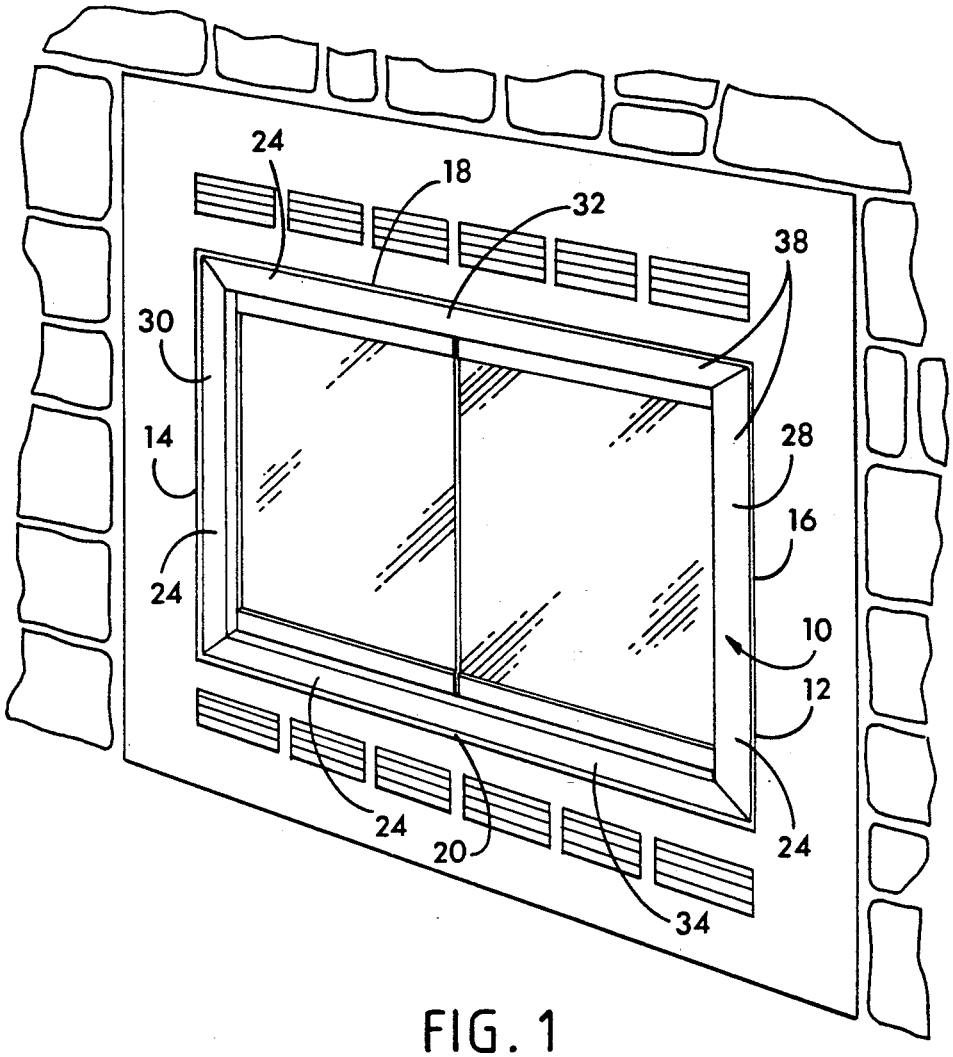
FIG. 1 is a perspective, environmental view of the frame assembly of the present invention as installed within a fireplace opening.

With reference to the drawings, a frame assembly of the present invention is shown in assembled relationship at 10 as mounted within a fireplace opening 12 in FIG. 1. The fireplace opening 12 as depicted in FIG. 1 is from a typical zero clearance fireplace unit, though it is to be understood that the frame assembly 10 as herein shown and described may be adapted to fireplace openings that are not of the zero clearance variety. The boundary of the fireplace opening 12 is defined by opposing left and right sidewall portions 14 and 16, that are oriented vertically, and opposing top and bottom sidewall portions 18 and 20, that are oriented horizontally. The boundary of the fireplace opening 12 is thus rectangular as herein illustrated, but the frame assembly 12 of the present invention is not necessarily limited to application within a rectangular opening. The frame assembly 10 is mounted within the boundary of the fireplace opening 12, the frame assembly 10 providing an ornamental facing and a jamb or structure within which a fireplace door 22 is installed. The fireplace door 22 as depicted in FIG. 1 is a cabinet-type door, although other types of doors, such as accordion or sliding doors, are possible. The door 22 is commonly formed of glass.

Figure 2:
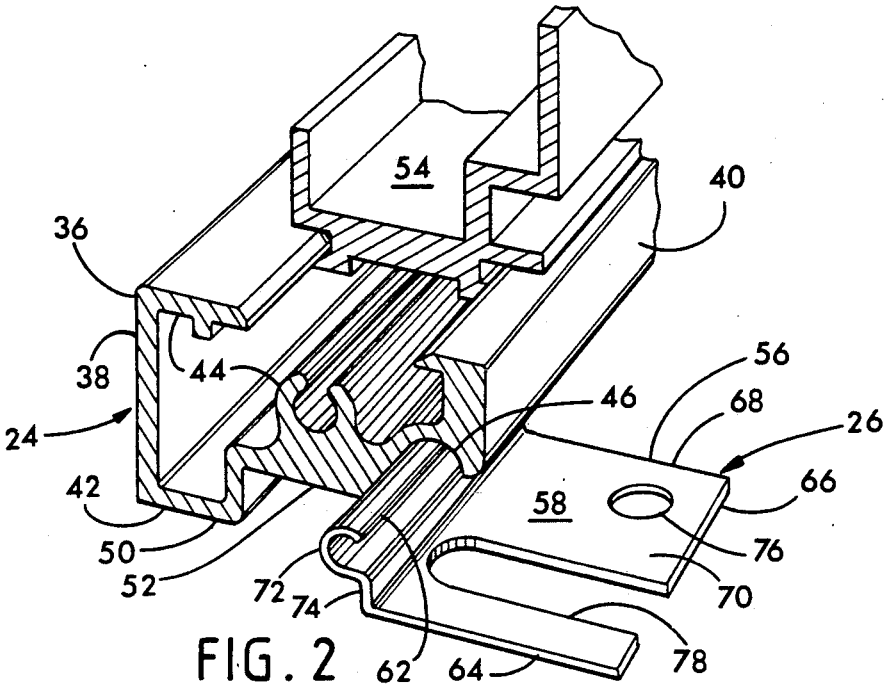
FIG. 2 is a fragmentary, perspective view of a clip of the present invention shown inserted within a frame member and poised for attachment to the fireplace opening.
Figure 3:
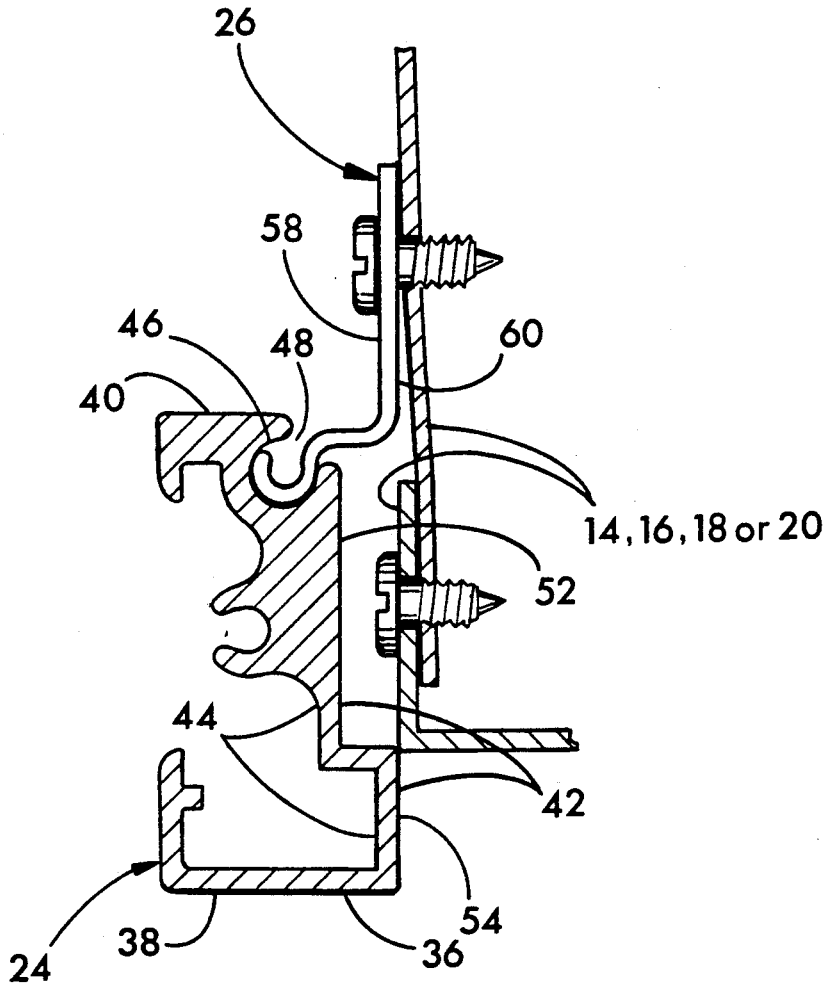
FIG. 3 is a lateral, cross-sectional view of the frame member of the present invention showing the mounting of the frame assembly within the fireplace opening.
Figure 4:
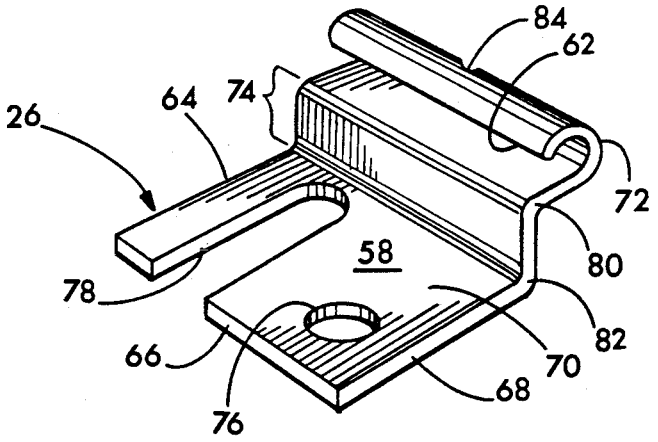
FIG. 4 is a perspective view of a clip that forms a part of the frame assembly of the present invention.
Figure 5:
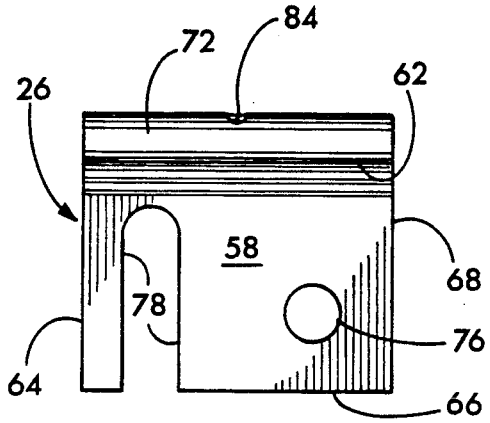
FIG. 5 is a top plan view of the clip that forms a part of the frame assembly of the present invention.
Figure 6:
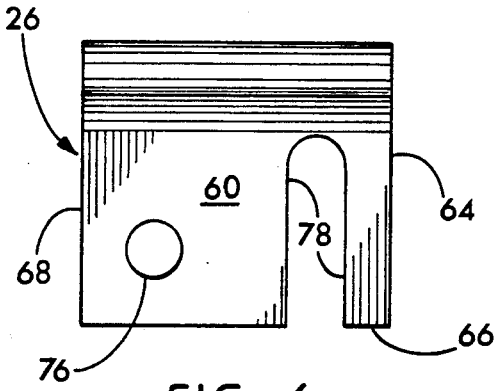
FIG. 6 is a bottom plan view of the clip that forms a part of the frame assembly of the present invention.
Figure 7:
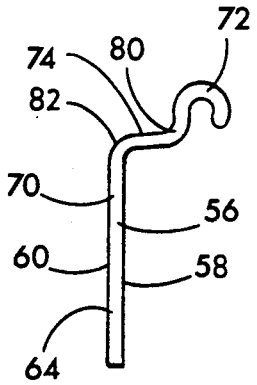
FIG. 7 is a right elevation view of the clip that forms a part of the frame assembly of the present invention, it being understood that the left elevation view is a mirror image thereof.
Figure 8:
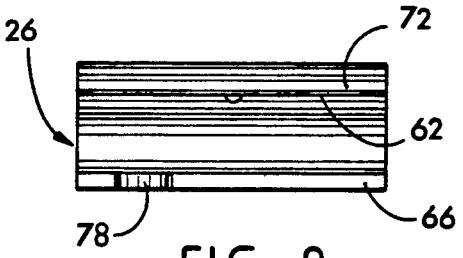
FIG. 8 is a front elevation view of the clip that forms a part of the frame assembly of the present invention.
Figure 9:
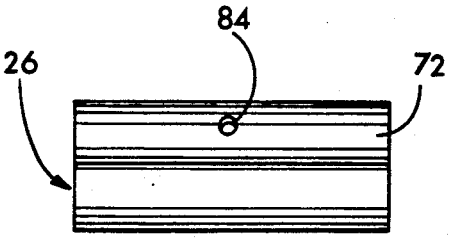
FIG. 9 is a rear elevation view of the clip that forms a part of the frame assembly of the present invention.

As illustrated in FIG. 2, the frame assembly 10 comprises a frame member 24 and a clip 26. FIG. 1 depicts the frame member 24 as having individual segments 28, 30, 32 and 34 of discrete lengths and which are fitted to the sidewall portions 14, 16, 18, and 20, respectively, of the fireplace opening 12. The individual segments 26, 28, 30, and 32 are preferably mitered at their ends in order to fit the individual segments 28, 30, 32, and 34 together. FIGS. 2 and 3 depict fragmentary and sectional views of the frame member 24 that show a profile or outer margin 36 directed along a longitudinal axis. Such a longitudinal axis is directed along the length of each of the discrete segments 28, 30, 32, and 34. For the case depicted in FIG. 1, the longitudinal axes and corresponding segments 28, 30, 32, and 34 are rectilinear to fit against the rectangular boundary formed by the sidewall portions 14, 16, 18 and 20. It is to be understood that the longitudinal axis may be curvilinear or shaped otherwise to fit against differently shaped wall portions that define the fireplace opening 12. The frame member 24 is preferably extruded of aluminum, and anodized to create the desired surface coating for protective and decorative reasons.

The outer margin 36 of the frame member 24 has a forwardly facing surface 38, a rearwardly facing surface 40 that opposes the forwardly facing surface 38, an exterior facing surface 42, and an interior facing surface 44 that opposes the exterior facing surface 42. The forwardly facing surface 38 faces toward the front of the fireplace opening 12 and provides an attractive edging or border within which is mounted the fireplace door 22, the forwardly facing surface 38 being variously configured to provide a selected visual appearance. The forwardly facing surface 38 of the frame member 24 in the depiction of FIGS. 1, 2, and 3 shows a forwardly facing surface 38 that is planar, though other decorative or aesthetic configurations are possible. A semicircular channel 46 is formed at the corner of the rearwardly facing surface 40 and the exterior facing surface 42 and is directed along the length or longitudinal axis of the frame member 24. An access opening 48 communicates with the semicircular channel 46. As is visible in FIGS. 2 and 3, the exterior facing surface 42 is configured to include a first planar level 50, and a second planar level 52 that is indented or offset from the first level 50. This particular configuration of an exterior facing surface 42 as herein shown and described is adapted for use with an opening 12 from a zero clearance fireplace unit. The reason for this configuration is readily apparent from the discussion, below, which relates to the operation of the present invention. It is to be understood, however, that the exterior facing surface 42 may be alternately configured, depending upon the characteristics of the fireplace opening 12. The interior facing surface 44 is shaped to receive hardware 54 related to the fireplace door 22. In FIG. 2, the hardware 54 is shown for illustrative purposes. The particular hardware 54 shown in FIG. 2 is used in combination with the segments 32 and 34 that are fitted to the horizontally oriented sidewalls 18 and 20, though it is to be understood that the hardware 54 does not form a part of the invention and may vary, depending on whether the segments are horizontal or vertical, or what type of fireplace door 22 is employed. Further, it is to be understood that the hardware 54 may also be incorporated as a part of the frame member 24.

FIGS. 2 and 3 illustrate the clip 26 in an assembled relationship with the frame member 24. Further, FIGS. 4–9 depict the clip 26 in greater detail independent of the frame member 24. The clip 26 is formed of a plate 56 having a first side 58, a second side 60 that opposes the first side 58, and edges 62, 64, 66, and 68 that define the outside boundary of the clip 26. The plate 56 of the clip 26 is formed in a fashion wherein it includes a planar portion 70, a lip 72, and a stepped portion 74 which is intermediate the planar portion 70 and the lip 72. The planar portion 70 of the clip 26 includes an aperture 76 that communicates between the first side 58 and the second side 60, and further includes a slot 78 that extends inwardly relative to the edge 66 and that also communicates between the first side 58 and the second side 60. The portion of the plate 56 which is proximal the edge 62 of the clip 26 is rolled into a semicircular configuration to form the lip 72. The lip 72 is sized to be matingly received within the semicircular channel 46 of the frame member 24. The stepped portion 74 includes a series of bends 80 and 82 that alter the relationship of the planar portion 70 of the clip 26 with respect to the lip 76. Depending on the type of fireplace opening 12, the configuration of the frame member 24, or the combination of the opening 12 and the frame member 24, the clip 26 may have differently configured stepped portions 74 to accommodate the above parts, or may lack the stepped portion 74 entirely. The clip 26 also has a threaded hole 84 which is optionally engaged by a set screw. For the clip 26 that combines with the frame member 24 described above, the hole 84 is centrally located within the lip 72. The clip 26 is preferably made of aluminum.

In the operation and assembly of the frame assembly 12, the clip 26 is positioned at a selected location along the length of the individual segments 28, 30, 32, or 34 of the frame member 24 by inserting the lip 72 into the semicircular channel 46 such as is depicted in FIGS. 2 and 3. The clip 26 is thus oriented such that the first side 58 of the planar portion 70 faces in the direction of the interior facing surface 44 of the frame member 24 and the second side 60 of the planar portion 70 faces in the direction of the exterior facing surface 42. The lip 72 of the clip 26 may be inserted into the semicircular channel 46 by one of two possible methods. In one method, the edge 62 is introduced into the access opening 48, the lip 72 then partially enters the semicircular channel 46, and the clip 26 may then be pivoted or urged along a substantially arcuately shaped path of travel into a position such as is represented in FIG. 3. The lip 72 of the clip 26 may, alternately, be inserted into the semicircular channel 46 by sliding the lip 72 into the channel 46 at one of the ends of the segments 28, 30, 32 and 34 of the frame member 24. When positioned at the desired location along the length of the segment 28, 30, 32 or 34 of the frame member 24, the set screw, where opted to be used, is tightened by engagement against the semicircular channel 46.

The clip 26 thus extends outwardly from the rearwardly facing surface 40 of the frame member 24. As shown in FIG. 3, the clip is oriented such that the second side of the clip 26 is flush or level with the first planar level 50 of the frame member 24. The second side 60 and the first planar level 50 thus squarely abuts against any of the side wall portions 14, 16, 18 and 20. A clearance 74 is formed between the second planar level 52 that is indented from the first level and the side wall portions 14, 16, 18 and 20. The clearance 74 allows heads 86 of machine screws 88 to nest within, the screws 88 being common to the assembly of zero clearance fireplaces. It is to be understood that different geometries of the side wall portions 14, 16, 18 and 20 may mandate uses of different types or shapes of frame members 24 or clips 26. Where appropriate to the geometry of the side wall positions 14, 16, 18 and 20, the clip 26 may also be reversible to secure the frame member 24 to the opening 12. By reversible it is meant that the clip 26 is turned end for end (edges 64 and 68 are flip flopped) and then inserted into the semicircular channel 46 such that the clip 26 extends outward from the exterior facing surface 42.

There may be any number of clips 26 positioned as described above in selected locations along the segments 28, 30, 32 and 34 of the frame member 24, depending upon the particular needs of an assembly process. However, it has been found that two clips 26 in spaced relation along the length of any one of the segments 28, 30, 32 and 34 is usually sufficient to secure the frame member 24 to the fireplace opening 12.

In attaching the clips 26 to the sidewall portions 14, 16, 18 and 20 of the fireplace opening 12, a screw 90 or similar type of fastener is made to extend through the aperture 76 or the slot 78 from the first side 58 and penetrates the particular side wall portion 14, 16, 18 or 20 into which the clip 26 is to be attached. Assembly of the frame assembly 10 may be accomplished in relatively rapid fashion in that the locations of the clip 26 may be quickly spotted and require no drilling or prepreparation of the frame member 24. Further, the locations of the clips 26 may be customized for a particular application without difficulty.

Figure 10:
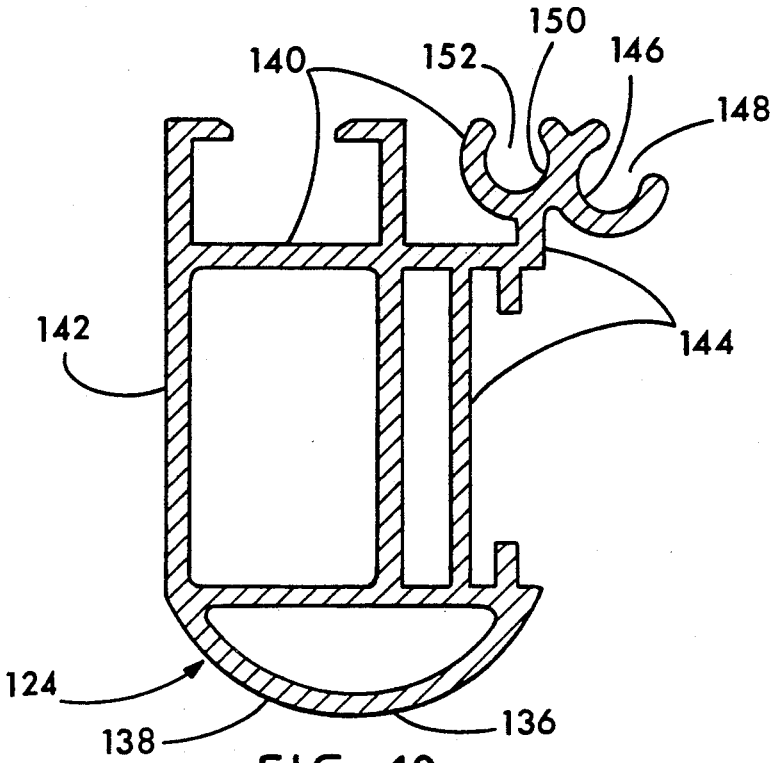
FIG. 10 is a lateral, cross-sectional view taken through an alternate frame member.

FIG. 10 shows the cross-section of an exemplary alternate frame member 124. The alternate frame member 124 has an outer margin 136, a forwardly facing surface 138, a rearwardly facing surface 140, an exterior facing surface 142, an interior facing surface 144, a semicircular channel 146, and an access opening 148 that are respectively analogous to the outer margin 36, the forwardly facing surface 38, the rearwardly facing surface 40, the exterior facing surface 42, the interior facing surface 44, the semicircular channel 46, and the access opening 48 of the frame member 24. The frame member 124 also incorporates a second semicircular channel 150 and corresponding access opening 152 that is parallel to the semicircular channel 146. The second semicircular channel 150 may be employed to slide a shield member therethrough for the case of fireplace openings that are not of the zero clearance variety, that is, openings bounded by brick and mortar. This will be discussed in greater detail below. The shield may act as a barrier to abut against the fireplace opening for aesthetic reasons. Specifically, the use of such a shield member may prevent cracks of light from passing between the frame member 124 and the opening, an aesthetically undesirable result. Channel 150 also may be used as an alternate channel for the clips 26, or for other desirable hardware.

Figure 11:
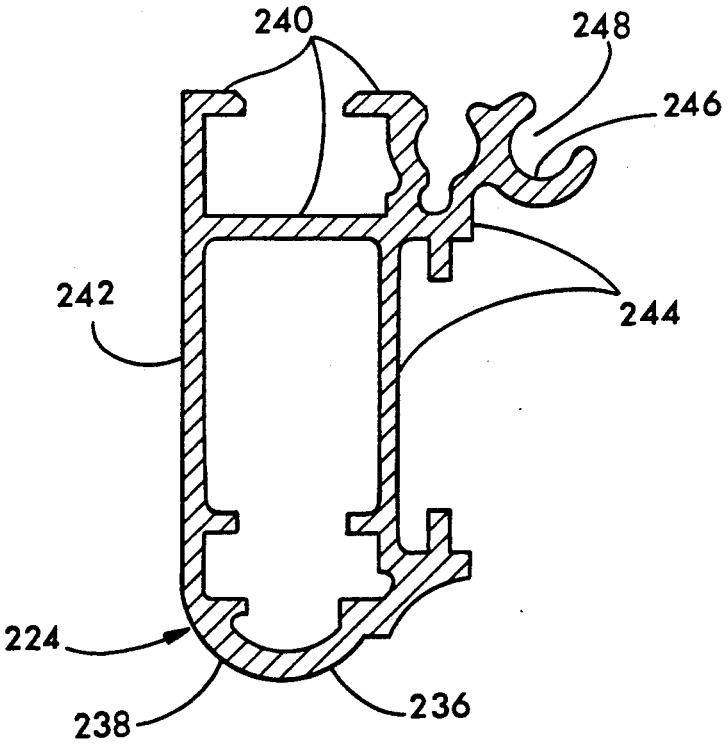
FIG. 11 is a lateral, cross-sectional view taken through a second alternate frame member.
Figure 12:
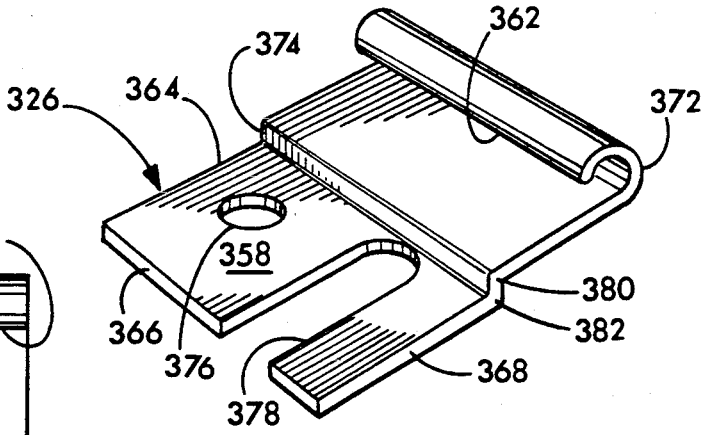
FIG. 12 is a perspective view of an alternate clip that forms a part of the frame assembly of the present invention.
Figure 13:
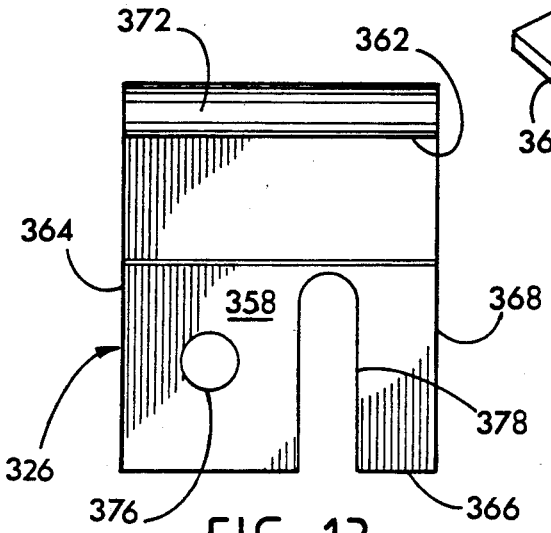
FIG. 13 is a top plan view of the alternate clip that forms a part of the frame assembly of the present invention.
Figure 15:
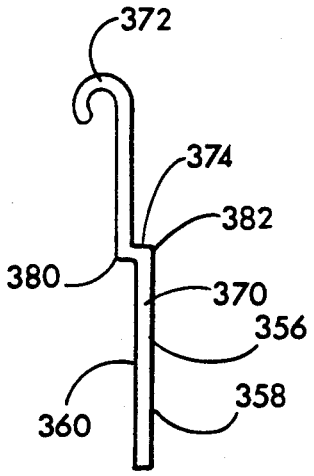
FIG. 15 is a right elevation view of the alternate clip that forms a part of the frame assembly of the present invention, it being understood that the left side view is a mirror image thereof.
Figure 14:
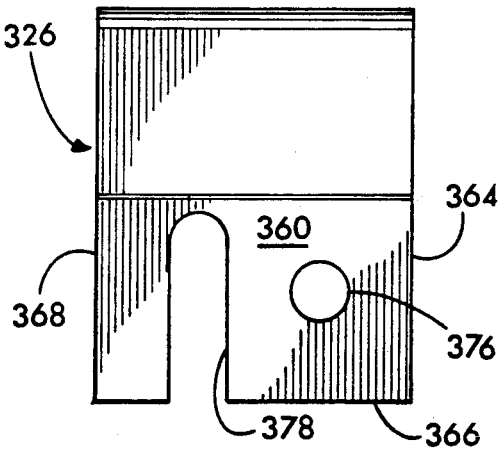
FIG. 14 is a bottom plan view of the alternate clip that forms a part of the frame assembly of the present invention.
Figure 16:
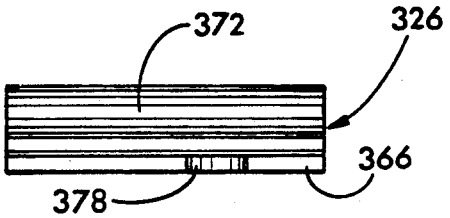
FIG. 16 is a front elevation view of the alternate clip that forms a part of the frame assembly of the present invention.
Figure 17:
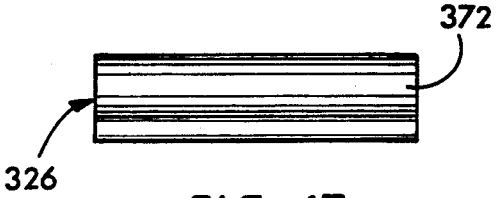
FIG. 17 is a rear elevation view of the alternate clip that forms a part of the frame assembly of the present invention.
Figure 18:
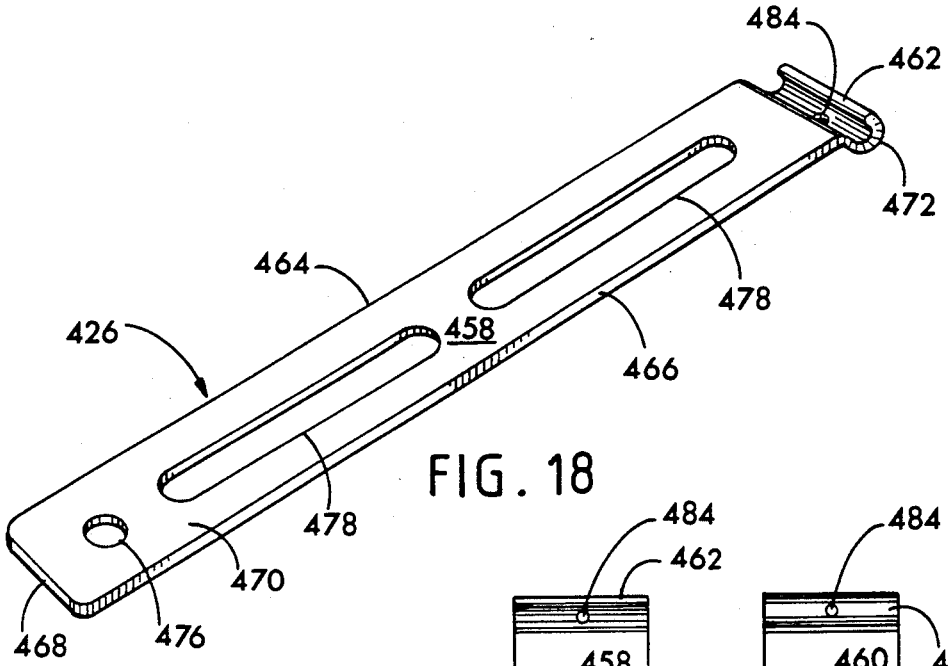
FIG. 18 is a perspective view of a second alternate clip that forms a part of the frame assembly of the present invention.
Figure 22:
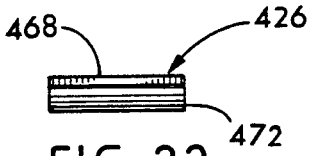
FIG. 22 is a front elevation view of the second alternate clip that forms a part of the frame assembly of the present invention.
Figure 23:
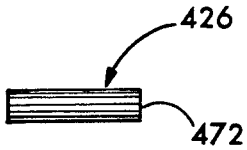
FIG. 23 is a rear elevation view of the second alternate clip that forms a part of the frame assembly of the present invention.
Figures 19, 20:
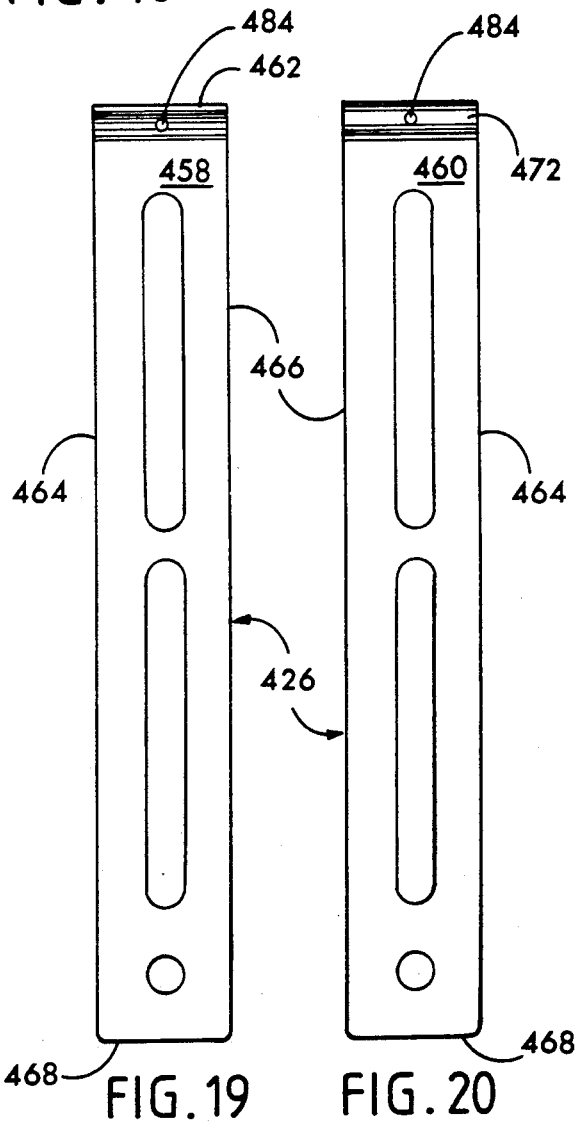
FIG. 19 is a top plan view of the second alternate clip that forms a part of the frame assembly of the present invention.
FIG. 20 is a bottom plan view of the second alternate clip that forms a part of the frame assembly of the present invention.
Figure 21:
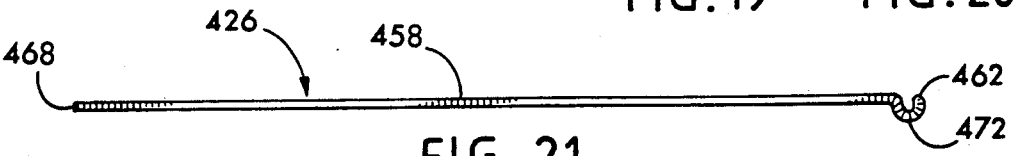
FIG. 21 is a right elevation view of the second alternate clip that forms a part of the frame assembly of the present invention, it being understood that the left elevation view is a mirror image thereof.

FIG. 11 shows the cross-section of an exemplary second alternate frame member 224. The second alternate frame member 224 has an outer margin 236, a forward facing surface 238, a rearwardly facing surface 240, an exterior facing surface 242, an interior facing surface 244, a semicircular channel 246, and an access opening 248 that are analogous to the outer margin 36, the forwardly facing surface 38, the rearwardly facing surface 40, the exterior facing surface 42, the interior facing surface 44, the semicircular channel 46, and the access opening 48. The frame member 224 also incorporates a second semicircular channel 250 and corresponding access opening 252 that is parallel to the semicircular channel 246. The second semicircular channel 250 is analogous in function to the second semicircular channel 150 of the frame member 124 as described above, and for the sake of brevity, is not herein repeated.

FIGS. 12–17 show an exemplary alternate clip 326. The alternate clip 326 has a first side 358, a second side 360, edges 362, 364, 366 and 368, planar portion 370, lip 372, stepped portion 374, aperture 376, and slot 378, that are analogous to the first side 58, the second side 60, the edges 62, 64, 66, and 68, the planar portion 70, the lip 72, the stepped portion 74, the aperture 76, and the slot 78, of the clip 26. The alternate clip 26 may be used where a different geometry of the side wall portions mandate use of different types or shapes of frame members or clips. The clip 326 does not employ a set screw.

FIGS. 18–23 show an exemplary second alternate clip 426. The second alternate clip 426 has a first side 458, a second side 460, edges 462, 464, 466 and 468, planar portion 470, lip 472, aperture 476, slot 478, and threaded hole 484 that are analogous to the first side 58, the second side 60, the edges 62, 64, 66 and 68, the planar portion 70, the lip 72, the aperture 76, the slot 78, and the threaded hole 84 of the clip 26. The particular configuration of the clip 426 does not have a stepped portion and the arrangement of the aperture 476 and slot 478 is slightly different. The second alternate clip 426 may be used where different geometries of the side wall portions mandate use of different types or shapes of frame members or clips. It is to be understood that the invention is not confined to the particular frame member profiles and clip configurations herein illustrated and described.

Figure 24:
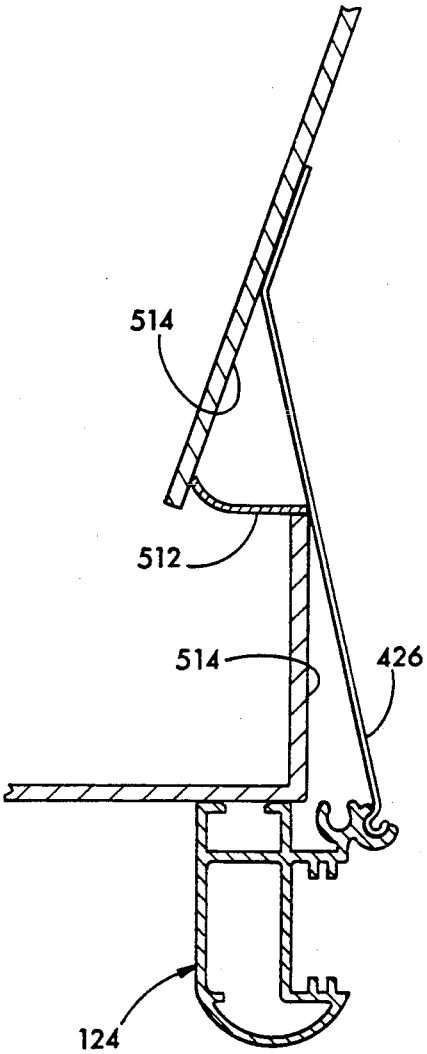
FIG. 24 is a lateral, cross-sectional view of the alternate frame member of FIG. 10 in combination with the second alternate clip of FIGS. 18–23 showing the mounting of the frame assembly within a fireplace opening of the facia type.
Figure 25:
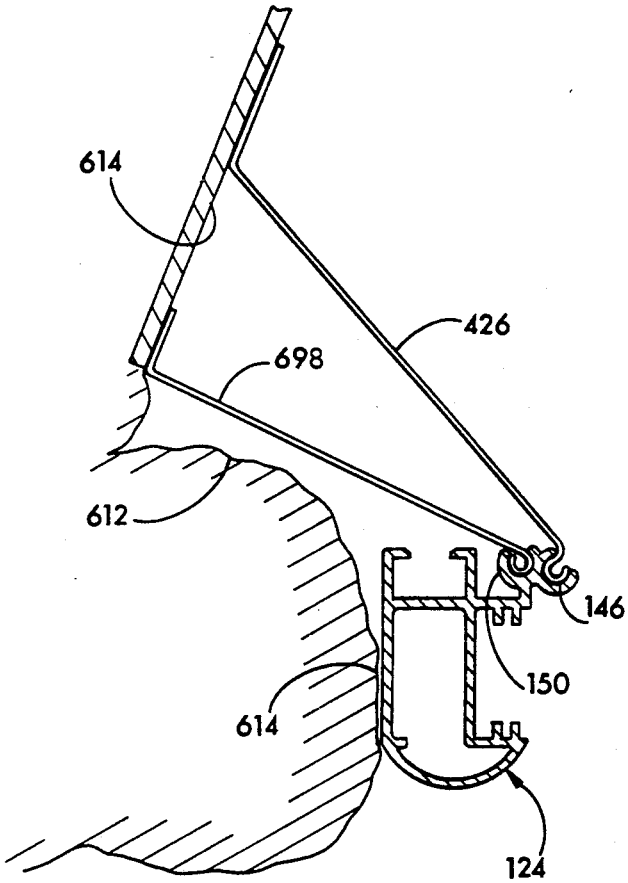
FIG. 25 is a lateral, cross-sectional view of the alternate frame member of FIG. 10 in combination with the second alternate clip of FIGS. 18–23 showing the mounting of the frame assembly within a fireplace opening of the stone face type.
Figure 26:
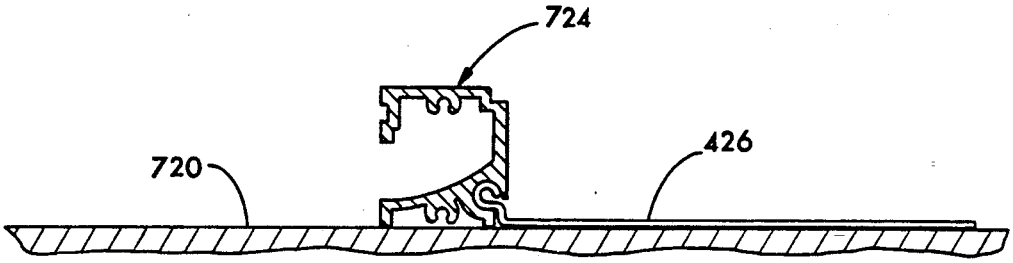
FIG. 26 is a lateral, cross-sectional view of a third alternate frame member in combination with the second alternate clip of FIGS. 18–23 showing the mounting of the frame assembly to the hearth of a fireplace opening.

FIGS. 24–26 show other exemplary arrangements of the frame assembly 10 represented by the present invention, and these depictions are not intended to be exhaustive of the possible arrangements and geometries of the frame members and clips considered within the scope of the present invention, nor exhaustive of the possible fireplace openings to which the frame assembly 10 may be attached. FIG. 24 illustrates use of the frame member 124 in combination with the clip 426 as mounted against a left side wall 514 of a fireplace opening 512 of the facia type. The clip 426, as made of aluminum, is readily formable against the contours of the side wall 514 or as otherwise required to mount the frame member 124. FIG. 25 illustrates the frame member 124 and the clip 426 as mounted against a left side wall 614 of a fireplace opening 612 of the stone face type. In the construction as depicted in FIG. 25, a shield member 698 is also employed as described above. The shield member 698 is slid through the second semicircular channel 150 to prevent cracks of light from passing between the frame member 124 and the fireplace opening 612 as viewed from the front. FIG. 26 shows yet another example of the frame assembly 10, combining a third alternate frame member 724 with the clip 426 for mounting to the bottom side wall or hearth 720 of a firebox.

It is generally understood that the invention is not confined to the particular construction and arrangement of parts herein illustrated and described, but embraces such modified forms thereof as come within the scope of the following claims.

What is claimed is:

1. A frame assembly for a fireplace door that is mounted within the boundary of a fireplace opening, the frame assembly comprising:

(a) a frame member having a length directed along longitudinal axis and which fits against a portion of the boundary of the fireplace opening, the frame member having an outer margin which includes a channel which is disposed in substantially parallel relation relative to the longitudinal axis of the frame member, the channel including an access opening; and (b) a clip having a main body which has an aperture formed therein and wherein the main body includes an edge having a predetermined shape and wherein the edge is matingly received within the channel of the frame member such that the clip may be variably positioned along the length of the frame member by repositioning the edge at different locations along the channel, and wherein the clip extends outwardly from the frame member and through the opening of the channel such that the aperture may be positioned against the fireplace opening to allow attachment of the frame to the fireplace opening by a fastener which extends through the aperture of the clip and into the boundary of the fireplace opening, wherein the frame member has a forwardly facing surface and an opposing rearwardly facing surface, the forwardly facing surface providing a facing for the fireplace opening and the channel being located on the rearwardly facing surface, the clip extending outwardly from the rearwardly facing surface of the frame assembly.

2. The frame assembly of claim 1 wherein the channel is semicircular.

3. The frame assembly of claim 2 wherein the main body of the clip includes a plate having opposite sides, and wherein one edge of the plate is formed into the shape which is matingly received within the semicircular channel.

4. The frame assembly of claim 3 wherein the main body of the clip further includes a bend intermediate the edge and the remainder of the plate, the bend being formed to fit one of the sides of the plate against the boundary which defines the fireplace opening.

5. The frame assembly of claim 1 wherein the body of the clip further includes a threaded hole, and a set screw is threaded within the threaded hole, and wherein the screw is capable of being tightened against the frame member thereby securing the clip at a selected predetermined position along the length of the frame member.

6. A kit which may be assembled to form a frame assembly for a fireplace door that is mounted within the boundary of a fireplace opening, the kit comprising:

(a) a frame member having a longitudinal axis and which fits against a portion of the boundary of the fireplace opening, the frame member having an outer margin which includes a channel which is disposed in substantially parallel relation relative to the longitudinal axis of the frame member, the channel including an access opening; and (b) a clip having a main body which has an aperture formed therein and wherein the main body includes an edge having a predetermined shape and wherein the edge is matingly received within the channel is of the frame member such that the clip may be variably positioned along the length of the frame member by repositioning the edge at different locations along the channel, and wherein the clip extends outwardly from the frame member and through the opening of the channel such that the aperture may be positioned against the fireplace opening to allow attachment of the frame to the fireplace opening by a fastener which extends through the aperture of the clip and into the boundary of the fireplace opening, wherein the frame member has a forwardly facing surface and an opposing rearwardly facing surface, the forwardly facing surface providing a facing for the fireplace opening and the channel being located on the rearwardly facing surface, the clip extending outwardly from the rearwardly facing surface of the frame assembly.

7. The kit of claim 6 wherein the channel is semicircular.

8. The kit of claim 7 wherein the main body of the clip includes a plate having opposite sides, and wherein one edge of the plate is formed into the shape which is matingly received within the semicircular channel.

9. The kit of claim 8 wherein the main body of the clip further includes a bend intermediate the edge and the remainder of the plate, the bend being formed to fit one of the sides of the plate against boundary which defines the fireplace opening.

10. The kit of claim 6 wherein the body of the clip further includes a threaded hole, and a set screw is threaded within the threaded hole, and wherein the screw is capable of being tightened against the frame member therefore to securing the clip at a selected predetermined position along the length of the frame member.

* * * * *